United States Patent [19]

Buhler

[11] Patent Number: 4,979,247

[45] Date of Patent: Dec. 25, 1990

[54] RAILROAD TRACK RENEWAL TRAIN

[75] Inventor: Fritz Buhler, Ecublens, Switzerland

[73] Assignee: Les Fils D'Auguste Scheuchzer S.A., Switzerland

[21] Appl. No.: 385,891

[22] Filed: Jul. 26, 1989

[30] Foreign Application Priority Data

Aug. 18, 1988 [EP] European Pat. Off. ..... 88810568

[51] Int. Cl.[5] ..... E01B 29/05

[52] U.S. Cl. ..... 104/5; 104/7.1; 104/9

[58] Field of Search ..... 104/2, 5, 7.1, 7.2, 104/9, 10, 12, 7.3

[56] References Cited

U.S. PATENT DOCUMENTS

| | | | |
|---|---|---|---|
| 3,744,428 | 7/1973 | Plasser et al. | 104/7.1 |
| 4,207,820 | 6/1980 | Cicin-Sain | 104/2 |
| 4,236,452 | 12/1980 | Theurer et al. | 104/2 |
| 4,253,398 | 3/1981 | Theurer et al. | 104/7.1 |
| 4,275,659 | 6/1981 | Theurer et al. | 104/2 |
| 4,867,068 | 9/1989 | Valditerra | 104/2 |

FOREIGN PATENT DOCUMENTS

| | | | |
|---|---|---|---|
| 0585814 | 3/1977 | Switzerland . | |
| 2029874 | 3/1980 | United Kingdom | 104/2 |
| 2080375 | 2/1982 | United Kingdom | 104/2 |

*Primary Examiner*—Robert P. Olszewski
*Assistant Examiner*—Mark T. Le
*Attorney, Agent, or Firm*—Kane, Dalsimer, Sullivan, Kurucz, Levy, Eisele and Richard

[57] ABSTRACT

The train comprises transport vehicles (16) for the new (T1) and old (T2) ties, followed by a storage vehicle (12) for the ties, a railroad car (1) as a dismantling car, articulated to the storage vehicle (12), and a laying unit (17) constructed in a manner such as to be mobile between a working state and a state of rest when running light. When working, this mobile unit (17) bears at one end on the car (1), for example via a wheel gear (22), and at the other end on a running support (24) which moves on the new track (R2). In the state of rest, the mobile unit (17) is moved and loaded onto the car (1), the running support (24) being retracted. The running support can also be formed by a railroad vehicle (26) or by a bissel truck (28), coupled to the car when running light.

15 Claims, 5 Drawing Sheets

RAILROAD TRACK RENEWAL TRAIN

FIELD OF THE INVENTION

Disclosed is a railroad track renewal train comprising transport vehicles for the new and old track elements, a dismantling unit for the old track, and a laying unit situated, in the working position, behind the dismantling unit.

PRIOR ART

Such a renewal train is described, for example, in patent No. CH-585 814. This renewal train, in common with the other types of train currently known, generally comprises two cars, one for the dismantling and the other for the laying of track. The two facing ends of the cars are supported on an intermediate truck, the wheels of which are retractable and, in the working position, are replaced by a caterpillar track capable of moving over the ballast; alternatively, in what are known as "flying buttress" trains, the truck is raised and remains suspended.

These track renewal trains enable all the operations to be performed simultaneously: in other words, once the fastenings securing the rails to the ties have been undone, they make it possible to lift and remove the old rails by means of grapplers, to dismantle the old ties and to convey them onto a transport car, to lay the new ties one at a time by means of the second car, these new ties being stored on a transport car, and, after positioning of the new ties, to lay the new rails which have previously been laid ready either side of the old track. In order to transport the new ties to the work site and remove the old ties, use is generally made of gantry cranes which can move on continuous craneways provided on the two working cars and on the transport vehicles, together with chain conveyors.

The current trains, with the two dismantling and laying cars, require relatively heavy chassis which are oversized in respect of the working load. In addition, the length of the machine when running light is determined by the length of the working sector, which can be considerable.

SUMMARY OF THE INVENTION

The object of the present invention is to provide a new track renewal train which makes it possible to adjust the size of the working units from case to case, to reduce the length of the working units when running light, and to reduce substantially the weight of the machine.

The object is achieved by replacing one of the two units, the one being in the form of a railroad car, equipped, at its end, with a truck whose wheels are retractable and replaced by caterpillar tracks when the train is working, and wherein the other unit is mobile, this mobile unit bearing on the one hand on the end of the car and on the other hand on a running support which moves along the tracks, the said mobile unit being loaded on the car when running light.

This track renewal train possesses the advantage of reducing the length of the working units to that of a single car, and making it possible to adapt the dimension of the elements of the mobile unit to working conditions and working requirements, which makes it possible to avoid the constraints imposed on a railroad car.

According to a preferred embodiment of the invention, the dismantling unit is formed by the car, while the laying unit is formed by a mobile beam whose ends are supported, respectively, by the dismantling car and by an auxiliary running carriage.

Advantageous embodiments of the invention are described in the dependent claims.

BRIEF DESCRIPTION OF THE DRAWINGS

The invention is explained in more detail below with reference to the attached drawings, in which.

DESCRIPTION OF THE PREFERRED EMBODIMENTS

Figure 1:
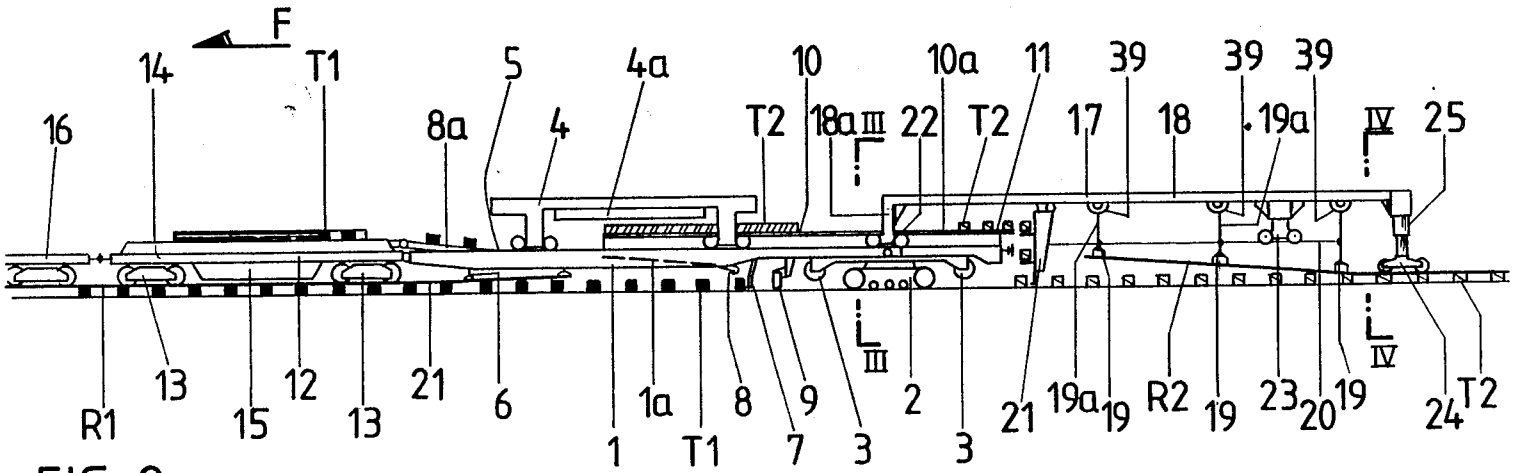
FIG. 1 is a diagrammatic view in elevation of a first embodiment of the renewal train, in the working position, where the car 1 is the dismantling unit and where the element 17 is the mobile laying unit, whose rear end rests on the new rails via a wheel gear as a running support.

According to the first embodiment illustrated in FIGS. 1 to 4, the renewal train comprises a railroad car 1 forming the dismantling unit and moving along the track in the direction of the arrow F. This car comprises a chassis 1*a* equipped, at its rear end 11, with a truck having two axles 3 whose wheels are retractable and between which is mounted a chassis having self-propelled caterpillar tracks 2 which are likewise retractable. The front end, which has no truck, rests on the tie storage vehicle 12, to which vehicle it is articulated. This makes it easier to comply with the structure clearance gauge through bends.

In the working position (FIG. 1), the tracked chassis 2 is lowered by hydraulic means in order to run on the ballast, while the wheels of the truck 3 are raised. In the position for running light (FIG. 2), the wheels of the truck 3 are lowered and run on the rails R while the tracked chassis 2 is raised.

The dismantling car 1 is equipped:

with a craneway 5 for a self-propelled gantry crane 4 having a lifting beam 4*a* fitted with grapplers for gripping, raising and transporting ties;

with rail grapplers 6 for lifting and removing the old rails R1;

with a dismantling installation 7 for the old ties T1;

with a plurality of in-line conveyors, for example 8, 8*a* (FIG. 1), for passing the old ties T1 from the installation 7 onto the conveyor 14 which is situated on the storage vehicle 12 where they are stored;

with a milling cutter 9 for leveling the berm;

with a plurality of in-line conveyors 10, 10*a* (FIG. 2) for the new ties T2.

In the figures, only two conveyors 8, 8*a* and 10, 10*a* have been shown, but in fact their number can vary as a function of requirements.

In front of the storage vehicle 12 are transport vehicles of which only one, 16, is shown in FIG. 1, coupled to the storage vehicle 12. All these vehicles 12, 16 are likewise equipped with the continuous craneway extending that, 5, which is installed on the car 1 to enable the gantry crane 4 to move along the car and along these vehicles.

The storage vehicle 12 for the old ties T1, articulated in front of the dismantling car 1, in terms of the direction of travel, rests on two motor trucks 13 and is equipped with a storage conveyor 14 for the old ties, with workplaces 15 for undoing the rail fastenings, and with the drive assembly for the self-propelled gantry crane 4 enabling a plurality of ties, for example thirty ties, to be picked up and conveyed.

The mobile laying unit 17 situated at the rear of the train is constructed in a manner such as to be convertible between a working state and a state of rest for the purposes of running light. In the working state (FIG. 1), the front end of the mobile laying unit 17 rests via a wheel gear 22 on the rear end of the car 1, while its rear end moves on the rails R2 of the new track, bearing on a running support formed in this case by a wheel gear 24 mounted via a strut 25 (FIG. 4) which can be raised vertically and which is formed, in the example in question, by telescopic jacks 25*a*, 25*b*, 25*c*.

According to this embodiment, the mobile unit 17 is formed by a laying beam 18 supported at its front end by a transverse frame 18*a* (FIG. 3) fixed to the wheel gear 22, resting on the craneway 5 and, at its rear end, by the strut 25 fixed to the wheel gear 24. From this beam 18 are suspended, by mobile arms 19*a*, roller grapplers 19 for the rails, controlled by jacks, and making it possible to lift and center the new rails R2, together with a known installation 21 for laying the new ties T2. The beam 18 is dimensioned solely for the lifting of the new rails.

Figure 2:
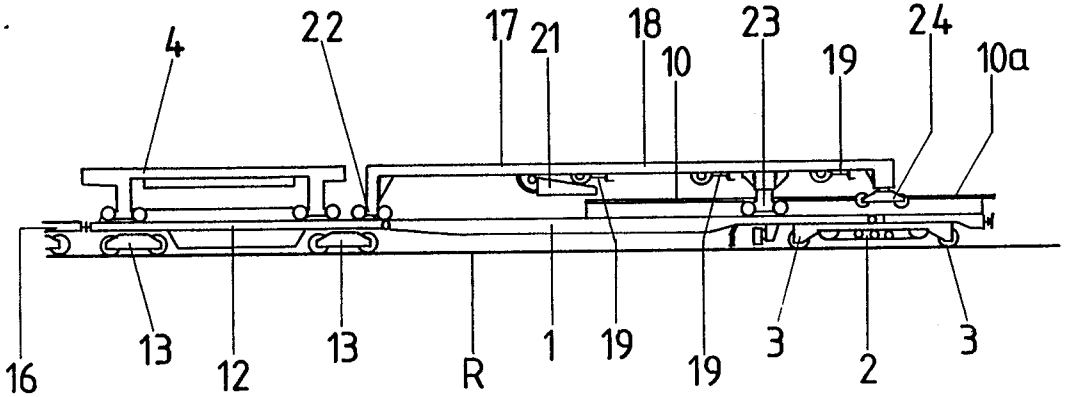
FIG. 2 shows the car and the mobile laying unit, according to FIG. 1, in the position for running light.
Figure 3:
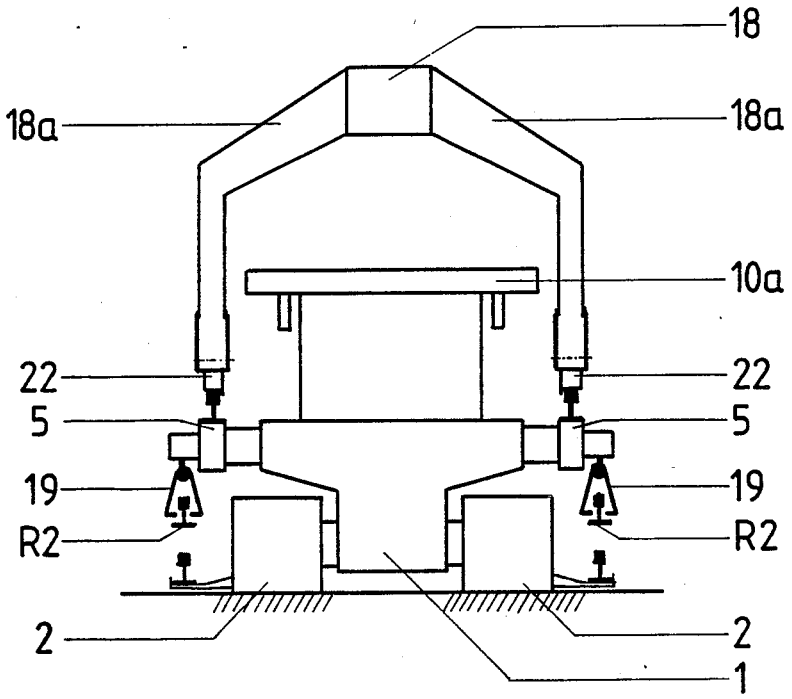
FIG. 3 is a cross-section along III—III of FIG. 1.
Figure 4:
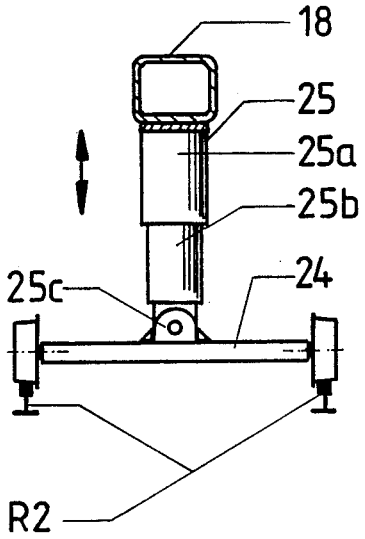
FIG. 4 is a cross-section along IV—IV in FIG. 1.
Figure 5:
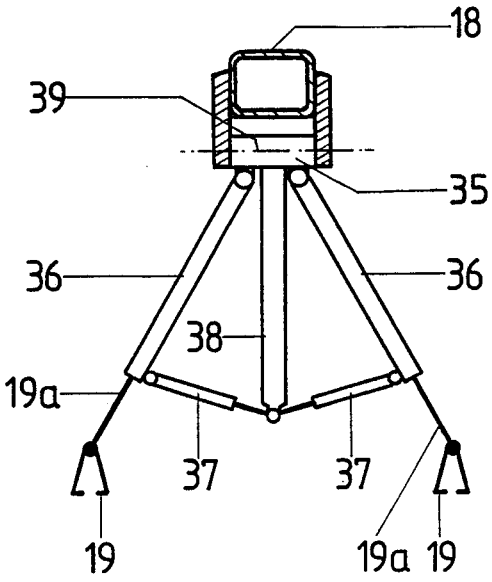
FIG. 5 shows diagrammatically the suspension of the rail grapplers, which are controlled by jacks and can be swung upwards.

FIG. 5 shows diagrammatically, in a transverse plane, an example of an arrangement of the suspension of the rail grapplers from the beam 18. According to this figure, the arrangement of the elements is suspended from a shaft 35 accommodated under the beam, which shaft can pivot about an axis 39 perpendicular to the longitudinal direction of the beam, this axis 39 likewise being visible in FIG. 1. To this shaft 35 are articulated two symmetrical jacks 36 provided at their lower end with an arm 19*a* bearing the roller grapplers 19 for the rails; and two other jacks 37, articulated on the one hand to a central rod 38 fixed to the shaft 35 and on the other hand to the lower end of the jacks 36, are provided for adjusting these rail grapplers in the lateral direction. The two roller grapplers 19 for the rails can be adjusted in height by the jacks 36, and in the lateral direction by the jacks 37. This shaft 35, pivoting about the axis 39, makes it possible in the position of rest to swing the arrangement upwards, as shown in FIG. 2.

In the working position, the rear wheel gear 24 forming the running support, and the rail grapplers 19, are drawn by cables 20 to relieve the load on the supporting construction of the beam 18. By pulling the wheel gear 24, and the rail grapplers 19 carrying the rails, via the cables 20, the torque force exerted on the beam 18 by all the loads which it supports is reduced or avoided. Consequently, these cables make it possible to use a lighter-weight construction in producing the mobile unit.

In order to bring the installation into the state of rest, the laying installation 21 and the rail grapplers 19 are lifted, and the unit 17 is moved towards the left in FIG. 1, onto the car 1 by causing the wheels 22 to run on the craneway 5. Then the wheel gear 23, fixed to the beam 18, supports the mobile unit 17 at the rear end for the purposes of running light. In the state of running light, shown in FIG. 2, the mobile unit 17 is completely loaded onto the car 1, the jacks 25*a* to 25*c* making it possible to lift the wheel gear 24 at the rear end.

The mode of operation of the renewal train is as follows: at the beginning of the site, the mobile unit 17 is moved back and the wheel gear 24 is lowered with the aid of the jacks 25*a* to 25*c* and centered on the track. Then, the installation 21 for &.he laying of the new ties is brought into the working position.

Renewal then begins: while the train advances in a continuous manner, the old rails R1, after their fastenings to the ties have been undone at the position 15 situated on the storage vehicle 12, are removed with the aid of rail grapplers 6, and the old ties T1 are dismantled one by one by the installation 7 comprising, in general, a type of fork which lifts the ties onto the conveyor 8, which passes them to the storage conveyor 14 of the storage vehicle 12 via the other conveyor 8*a*. Behind the dismantling installation, the sub-grade is leveled and, if necessary, lowered by means of the milling cutter 9.

As soon as the wheels of the truck 3 which are used for light running have approached the zone which is free of rails and tie, these wheels are retracted to be replaced by the tracked chassis 2 which is lowered and now runs on the ballast.

By means of the gantry crane 4 and its lifting beam 4*a* fitted with grapplers, new ties T2, for example thirty, are now brought from one of the transport vehicles 16 situated at the head of the train and are unloaded onto the conveyor 10. Then, still by means of the gantry crane 4, the same number of old ties T1 stocked on the storage conveyor 14 are taken and are discharged onto one of the transport vehicles 16. When the laying installation 21 arrives at the level of the zone having no rails, the new ties T2 are positioned one by one via the installation 21. The new rails R2, previously laid ready on each side of the former track, are lifted, centered and laid by means of the rail grapplers 19 on the new ties T2. These operations are repeated while the train advances in a continuous manner and the wheel gear 24 runs on the new rails R2.

At the end of the site, when the wheels of the truck 3 arrive above the rails which are adjacent to the end of the renewed zone, this truck 3 is lowered onto the said rails while the tracked chassis 2 is raised, as illustrated in FIG. 2, and the last new rail is again laid to fill the gap. Then the installation 21 for laying the new ties is raised, or swung into a horizontal position, the roller grapplers 19 for the rails with the jacks 36, 37 are swung upwards, and then the beam 18 is advanced onto the car 1. As soon as the auxiliary wheel gear 23 rests on the craneway 5 of the car 1, the rear wheel gear 24 is raised and the entire installation is brought into the position for running light.

Figure 6:
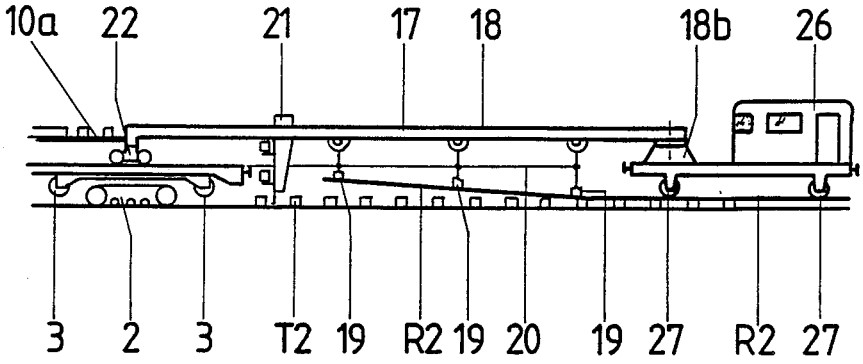
FIG. 6 shows a second embodiment of the running support for the rear end of the mobile laying unit, formed by a railroad vehicle.

The running support for the mobile laying unit 17 may be constructed in different manners. For example, according to the embodiment shown in FIG. 6, the rear end of the beam 18 bears, via an articulation 18*b*, for example a turntable, on a railroad vehicle 26, while its front end bears, as in the previous embodiment, on a wheel gear 22 which runs on the craneway 5 of the car 1. The railroad vehicle 26 is mounted on two axles 27 and is coupled, in the position for running light, to the car 1. Roller grapplers 19 for the rails and the laying installation 21 for the new ties T2 are likewise suspended from the beam 18. The other elements of the car 1 are the same as in the previous embodiment. The railroad vehicle 26 can be equipped with working positions for assembling the fastenings of the new rails, and can also be used as a materials transport vehicle.

Figure 7:
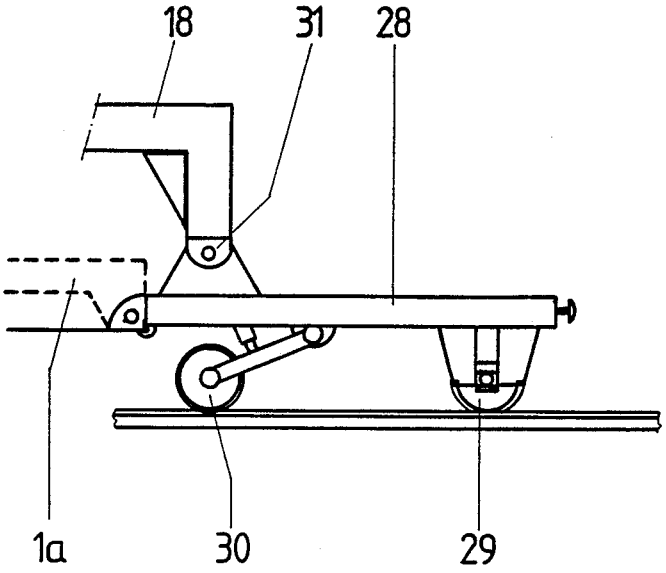
FIG. 7 shows a third embodiment of the running support, formed by a bissel truck having an auxiliary axle.

According to another embodiment of the running support for the mobile laying unit 17, shown in FIG. 7, the rear end of the beam 18 bears, via an articulation 31, on a bissel truck 28 equipped with a fixed axle 29 and with a mobile auxiliary axle 30 which can be lowered in the working position and raised in the position for running light, in which it is coupled to the chassis 1*a* of the car 1 as shown in dashed lines in FIG. 7.

Figure 8:
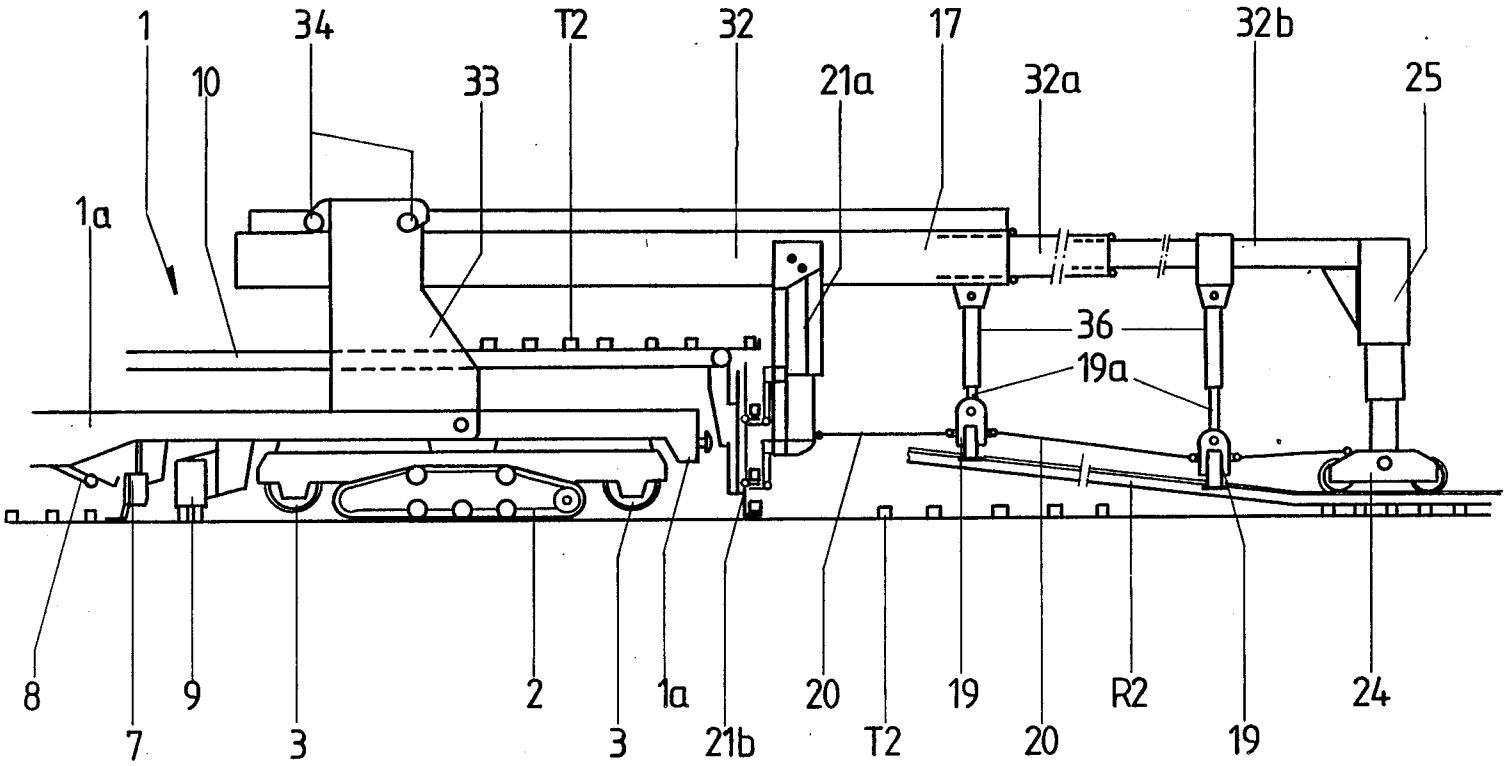
FIG. 8 shows a fourth embodiment of the renewal train, with a different design of the mobile laying unit, in the form of a telescopic unit.

Finally, according to another embodiment shown in FIG. 8, the unit 17 comprises a mobile laying beam formed by three telescopic elements 32, 32*a*, 32*b*, the front element 32 of this beam being suspended and sliding in a frame 33 mounted at the rear of the chassis 1*a* of the car 1 while the rear end of the latter element 32*b* bears, via a strut 25 composed of jacks, as shown in FIG. 1, on a wheel gear 24 as a running support which can be raised in the position for running light. This wheel gear 24 could likewise be replaced by a railroad vehicle or by a bissel truck, as described previously. As in the first embodiment described, from this telescopic beam are suspended roller grapplers 19 for the rails, via the arms 19*a* and the jacks 36, and an installation for laying the new ties T2.

In the embodiment shown in FIG. 8, the installation for laying the new ties is formed of two parts, namely a vertical conveyor 21*a* and a tie-layer 21*b*. The vertical conveyor 21*a* is suspended in a pivotable manner on the first element 32 of the telescopic beam, while the tie-layer 21*b* is mounted to be pivotable or removable on the rear end of the car 1. The other elements are the same as in the first embodiment and bear the same references.

Moreover, in the example of embodiment according to FIG. 8, it is also possible for the laying installation for the new ties to be entirely mounted on the beam 18 or completely mounted at the end of the car 1. In this latter case, the laying unit serves only to center the new rails and is relieved of the load of the laying installation. The alternative embodiments which have just been mentioned in connection with the laying installation can also be applied to the embodiment according to FIG. 1, that is to say that instead of being mounted on the beam, this laying installation could be completely mounted at the end of the car 1, or partly on the car and partly on the beam.

In every case, this installation is brought into the transport position, for example, with the aid of hydraulic jacks making it possible to raise and pivot the various parts.

Figure 9:
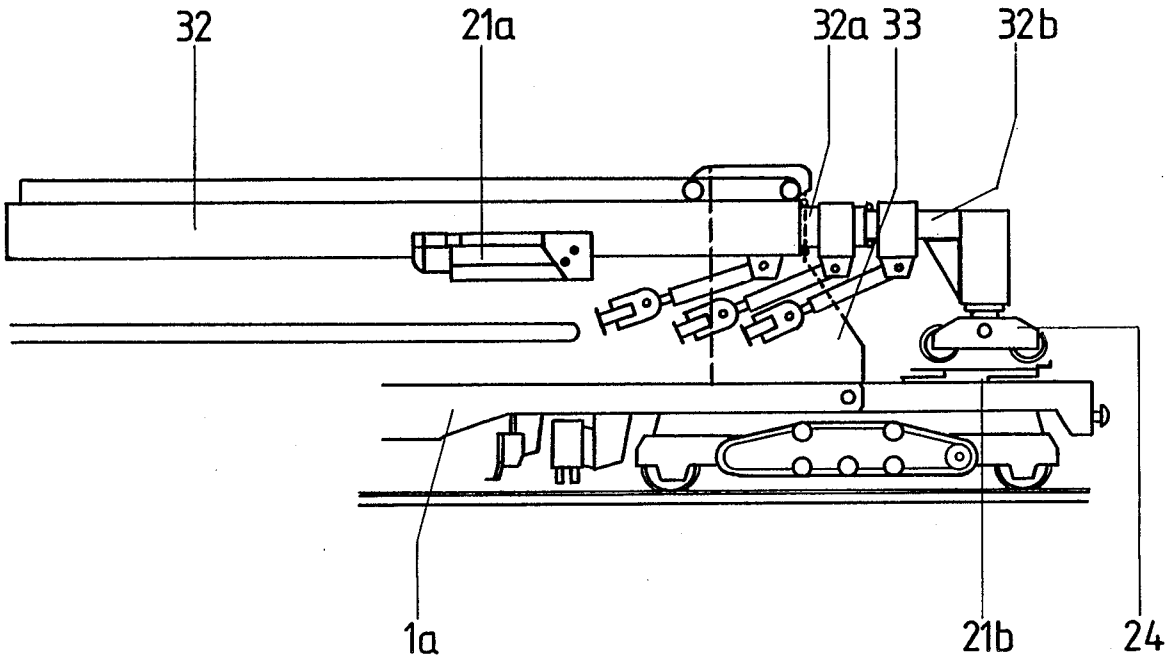
FIG. 9 shows the train according to FIG. 8 in the retracted state.

To convert the mobile unit 17, according to FIG. 8, into the state of rest, the wheel gear 24 is raised, and the rail grappler arrangements 19 together with the laying installation for the new ties 21*a*, 21*b* are pivoted; then the front telescopic element 32 is slid forward, through the frame 33, until it is situated entirely above the car 1, the front end of this element 32 overlapping outside the frame, and guidance being provided by rollers 34 provided in the frame 33; then the other elements 32*a*, 32*b* are retracted into the first element 32 as shown diagrammatically in FIG. 9.

Naturally, as in the example of FIG. 1, the running support formed by a wheel gear 24 is raised by means of the jack 25 and is situated, in the state of rest, entirely on the car 1, without any element overlapping the rear end thereof. The vertical conveyor 21*a* is brought into an approximately horizontal position below the element 32, while the tie-layer 21*b* is pivoted on the chassis 1*a* of the car 1 or is dismantled and placed on this car. It is not absolutely necessary that nothing should overlap the rear side of the frame 33, but nothing must overlap the rear end of the car 1.

It is possible to reverse the laying and dismantling functions, in that the mobile laying unit becomes the dismantling unit while the unit constructed as a railroad car becomes the laying unit. In this case, the transport vehicles are situated behind the laying car and the train can be pushed. The storage vehicle 12 serves for intermediate storage of the new ties which are to be conveyed on the adjacent laying car while the dismantled ties are conveyed by the gantry crane towards a transport vehicle 16.

If a railroad vehicle 26 or a bissel truck 28 is used as a running support, this running support can also be used for the work of undoing the rail fastenings at the head of the train.

The invention is not restricted to the embodiments described but may exhibit numerous variations.

I claim:

1. A railroad track renewal train comprising:

transport vehicles (16) for new ties (T1) and old ties (T2), a dismantling unit (1) behind the transport vehicles, a laying unit (17) situated, in a working position, behind the dismantling unit, wherein only one of the two units is constructed in the form of a railroad car (1), equipped, at its end, with a truck including means for retracting rail engaging wheels so as to support said railroad car on caterpillar tracks, when the train is working, and wherein the other unit (17) is mobile, this mobile unit (17) bearing with its one end on the railroad car (1) and with its other end on a running support which moves along railroad tracks, said train including means for retracting and loading said mobile unit onto said railroad car when running light.

2. The renewal train as claimed in claim 1, wherein the one end of the railroad car (1) is articulated to a storage vehicle (12) and has no truck, bearing in a pivoting manner on the chassis of this storage vehicle (12).

3. The renewal train as claimed in claim 1, wherein the mobile unit (17) consists of at least one beam (18) from which laying elements are suspended, and wherein the said beam bears and is movable on the said railroad car (1) by a wheel gear (22).

4. The renewal train as claimed in claim 1, wherein the said mobile unit (17) consists of a telescopic beam (32, 32*a*, 32*b*) from which laying elements are suspended, the extended end of the said beam bearing, in the working position, on the running support (24), while the other end is suspended from a frame (33) mounted at an adjacent end of the railroad car (1), telescopic elements of this beam being retracted one into the other and being entirely loaded on the railroad car (1) when running light.

5. The renewal train as claimed in claim 1, wherein the said running support is a wheel gear (24) mounted via a retractable strut (25) in order to be retracted when running light.

6. The renewal train as claimed in claim 5, wherein the mobile unit (17) is equipped with an auxiliary wheel gear (23) on which the said mobile unit (17) bears when running light.

7. The renewal train as claimed in claim 1, wherein the running support is a railroad vehicle (26) which is coupled to the railroad car (1) in the position for running light.

8. The renewal train as claimed in claim 1, wherein the running support is a bissel truck (28, 29) which is coupled to the railroad car (1) in the position for running light and is equipped with a mobile auxiliary axle (30) which is lowered in the working position and retracted when running light.

9. The renewal train as claimed in claim 3, wherein the transport vehicles (16), the railroad car (1), and a storage vehicle (12) connected between the railroad car (1) and one of said transport vehicles (16) are equipped with a continuous craneway (5) for at least one gantry (4) for lifting and transporting the ties, and wherein the craneway (5) likewise serves for moving the wheel gear (22).

10. The renewal train as claimed in claim 1, wherein the railroad car (1) comprises a storage unit for the old ties and equipped with installations for undoing fastenings securing old rails to the old ties.

11. The renewal train as claimed in claim 1, further comprised of a laying installation (21) on the mobile unit for railroad ties, wherein said laying installation includes means for folding the laying installation (21) back on the mobile unit.

12. The renewal train as claimed in claim 1, further comprised of rail grapplers (19) on the mobile unit, wherein the rail grapplers and the running support for the mobile unit (17) are pulled by cables (20), said mobile unit further comprised of a laying beam, said pulling of the cables relieving the load on the laying beam.

13. The renewal train as claimed in claim 1, wherein the mobile unit forms the laying unit equipped with laying installations and wherein the railroad car (1) forms the dismantling unit.

14. The renewal train as set forth in claim 5, wherein the retractable struts are comprised of lifting jacks capable of being retracted when running light.

15. The renewal train as claimed in claim 9, wherein said craneway (5) serves for moving an auxiliary wheel gear (23).

* * * * *